US007473842B2

(12) United States Patent
Naito

(10) Patent No.: US 7,473,842 B2
(45) Date of Patent: Jan. 6, 2009

(54) ELECTRONIC KEYBOARD INSTRUMENT

(75) Inventor: Haruyoshi Naito, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 401 days.

(21) Appl. No.: 10/950,318

(22) Filed: Sep. 23, 2004

(65) Prior Publication Data

US 2005/0066798 A1 Mar. 31, 2005

(30) Foreign Application Priority Data

Sep. 25, 2003 (JP) ..... 2003-333417

(51) Int. Cl.
*G10H 1/32* (2006.01)

(52) U.S. Cl. ..... 84/644; 84/670; 84/718; 84/743

(58) Field of Classification Search ..... 84/644, 84/670, 718, 719, 743, 744, 438, 446; 248/431, 248/150
See application file for complete search history.

(56) References Cited

U.S. PATENT DOCUMENTS 3,391,241 A * 7/1968 Andersen ..... 84/718
3,643,000 A * 2/1972 Andersen ..... 84/600
3,681,508 A * 8/1972 Bohm ..... 84/713
3,750,516 A * 8/1973 Olson ..... 84/470 R
4,331,312 A * 5/1982 LaVoe ..... 248/201
4,545,280 A * 10/1985 Bisey ..... 84/177
4,656,913 A * 4/1987 Yoshikawa ..... 84/177
4,770,380 A * 9/1988 Eason et al. ..... 248/165
5,031,500 A * 7/1991 Koike et al. ..... 84/600
5,086,686 A * 2/1992 Misawa et al. ..... 84/718
5,149,905 A * 9/1992 Count ..... 84/744
5,248,846 A * 9/1993 Koike et al. ..... 84/718
5,312,076 A * 5/1994 Rogov ..... 248/165
5,335,283 A * 8/1994 Torii ..... 381/118
5,396,398 A * 3/1995 Gill ..... 361/679
5,465,644 A * 11/1995 Shimoda et al. ..... 84/423 R
5,789,693 A * 8/1998 Lawson ..... 84/744
5,929,362 A * 7/1999 Oteyza ..... 84/743
6,020,549 A * 2/2000 Reimann et al. ..... 84/423 R
6,087,574 A * 7/2000 Kitashima et al. ..... 84/423 R (Continued)

FOREIGN PATENT DOCUMENTS

JP S57-19793 2/1982

(Continued)

*Primary Examiner*—David S. Warren
(74) *Attorney, Agent, or Firm*—Morrison & Foerster LLP

(57) ABSTRACT

An electronic keyboard instrument which enables an instrument frame to be shared by different types of electronic keyboard instruments, and facilitates separate mounting and removal of a keyboard unit and a tone-generating unit. A frame assembly (FAS) has a pair of left and right frame bodies (LFM and RFM) and upper and lower connecting members (20AS and 30AS). The frame assembly is configured such that the two frame bodies are connected together via the connecting members. A pair of keyboard unit-holding parts (16La and 16Ra) are provided respectively on the two frame bodies of the frame assembly. The keyboard unit-holding parts are capable of selectively holding one of a plurality of types of keyboard units (KB). A pair of speaker unit-holding parts (17La and 17Ra) are provided respectively on the two frame bodies, separately from the keyboard unit-holding parts. The speaker unit-holding parts are capable of selectively holding one of a plurality of types of speaker units (SP).

12 Claims, 5 Drawing Sheets

U.S. PATENT DOCUMENTS

| | | | | |
|---|---|---|---|---|
| 6,376,759 | B1 * | 4/2002 | Suzuki | 84/615 |
| 6,399,870 | B1 * | 6/2002 | Azima et al. | 84/744 |
| 6,916,980 | B2 * | 7/2005 | Ishida et al. | 84/743 |
| 7,060,890 | B2 * | 6/2006 | Sato et al. | 84/745 |
| 7,078,611 | B2 * | 7/2006 | Izumi et al. | 84/743 |
| 7,119,269 | B2 * | 10/2006 | Furuhashi | 84/744 |
| 7,247,788 | B2 * | 7/2007 | Lai | 84/719 |
| 7,329,812 | B2 * | 2/2008 | Kuwahara et al. | 84/744 |
| 2001/0049995 | A1 * | 12/2001 | Torii et al. | 84/718 |
| 2003/0196541 | A1 * | 10/2003 | Ishida et al. | 84/622 |
| 2004/0173086 | A1 * | 9/2004 | Sato et al. | 84/745 |
| 2004/0206226 | A1 * | 10/2004 | Negoescu et al. | 84/600 |
| 2005/0066798 | A1 * | 3/2005 | Naito | 84/743 |
| 2005/0155486 | A1 * | 7/2005 | Furuhashi | 84/746 |

FOREIGN PATENT DOCUMENTS

| | | |
|---|---|---|
| JP | S62-46232 | 3/1987 |
| JP | 2000081885 | 3/2000 |
| JP | 2002244661 | 8/2002 |

* cited by examiner h1
18L
KB
KBa1
41
43L
42L
42R
KBa2
43R
SP
39a
39
16Lab
20ASc
13L
16L
17L
12L
17La
16La
14L
40
41
20AS
20ASd
13R
16Laa
16Ra
16R
39b
15L
12R
11L
h1

14R
30AS
LFM
30ASc
FAS
20AS
18L
30AS
30ASd
RFM
PK
11R
18R
15R
10R

ELECTRONIC KEYBOARD INSTRUMENT

BACKGROUND OF THE INVENTION

1. Field of the Invention

The present invention relates to an electronic keyboard instrument wherein a keyboard unit and a sound-generating unit are held by an instrument frame.

2. Description of the Related Art Conventionally, there have been proposed electronic keyboard instruments in which a keyboard unit including a keyboard section and a sound-generating unit including speakers are formed in separate bodies. In an electronic keyboard instrument in general, a keyboard unit and a sound-generating unit are secured to a keybed provided on an instrument frame. The keybed does not only hold the keyboard unit and the sound-generating unit, but also reinforces the instrument frame.

An electronic keyboard instrument has also been proposed in Japanese Laid-Open Patent Publication (Kokai) No. 2002-244661, in which the bottom of a keyboard unit forms a keybed, and a sound-generating unit is secured to the bottom of the keyboard unit (first prior art).

Another electronic keyboard instrument has been proposed in Japanese Utility Model Publication (KOKOKU) No. S62-46232, in which a keyboard unit is removably mounted on an instrument frame (second prior art).

However, the conventional electronic keyboard units still remain to be improved in the arrangement of the keyboard unit and the sound-generating unit, as well as in the mechanism that hold these parts.

That is, in general, the keyboard unit and the sound-generating unit are not intended to be removed or replaced with other types, and therefore the associated instrument frame is also designed specifically for a particular type of electronic keyboard instrument.

Further, even if the sound-generating unit is configured to be replaceable with another type, for example, it is not easy to carry out the replacing operation of the sound-generating unit if the sound-generating unit is secured to a keybed or the bottom of a keyboard unit with screws from below, as illustrated by an example in the first prior art. Depending on the arrangement, it is difficult to mount or remove the sound-generating unit separately or singly, or it is necessary to remove the keyboard unit to allow replacement of the sound-generating unit.

Furthermore, if the keyboard unit contains a main circuit, for example, the keybed can be an obstacle to wiring between the keyboard unit and the sound-generating unit, making it difficult to carry out wiring.

SUMMARY OF THE INVENTION

It is a first object of the present invention to provide an electronic keyboard instrument which enables an instrument frame to be shared by different types of electronic keyboard instruments, and facilitates separate mounting and removal of a keyboard unit and a tone-generating unit.

It is a second object of the present invention to provide an electronic keyboard instrument which enables a tone-generating unit to be easily mounted and removed singly, with a keyboard unit remaining held in the instrument.

It is a third object of the present invention to provide an electronic keyboard instrument which can dispense with a keybed to facilitate wiring between a keyboard unit and a tone-generating unit.

To attain the above first object, in a first aspect of the present invention, there is provided an electronic keyboard instrument comprising an instrument frame (FAS) having a pair of left and right legs (LFM, RFM), and at least one connecting member (20AS, 30AS), the pair of legs being connected together via the connecting member, a pair of keyboard unit-holding parts (16La, 16Ra) provided respectively on the pair of legs of the instrument frame, the keyboard unit-holding parts being capable of selectively holding one of a plurality of types of keyboard units (KB), and a pair of sound-generating unit-holding parts (17La, 17Ra) provided respectively on the pair of legs of the instrument frame, separately from the keyboard unit-holding parts, the sound-generating unit-holding parts being capable of selectively holding one of a plurality of types of sound-generating units (SP).

With this arrangement of the electronic keyboard instrument according to the first aspect of the present invention, it is possible to cause the keyboard unit-holding parts and sound-generating unit-holding parts formed in separate bodies to selectively hold a desired one of a plurality of types of keyboard units and a desired one of a plurality of types of sound-generating units. Therefore, it is possible to commonly use the instrument frame for different instrument types, and facilitate separate mounting and removal of the keyboard unit and the tone-generating unit.

To attain the above second object, in a second aspect of the present invention, there is provided an electronic keyboard instrument comprising an instrument frame (FAS) having a pair of left and right legs (LFM, RFM), and at least one connecting member (20AS, 30AS), the pair of legs being connected together via the connecting member, a keyboard unit (KB) having laterally opposite ends (KBa1, KBa2) having respective bottoms, and a keyboard section, a sound-generating unit (SP) having a top having laterally opposite ends (39*a*, 39*b*), a pair of keyboard unit-holding parts (16La, 16Ra) provided respectively on the pair of legs of the instrument frame at locations inward of and between the pair of legs in opposed relation to each other, the keyboard unit-holding parts supporting respectively the bottoms of the laterally opposite ends of the keyboard unit, and a pair of sound-generating unit-holding parts (17La, 17Ra) provided respectively on the pair of legs of the instrument frame at locations inward of and between the pair of legs in opposed relation to each other, the sound-generating unit-holding parts holding the sound-generating unit in a manner such that the laterally opposite ends of the top of the sound-generating unit are fixed to the sound-generating unit-holding parts, wherein the sound-generating unit-holding parts are located at a level below the keyboard unit-holding parts, whereby, when the laterally opposite ends of the top of the sound-generating unit are not fixed to the sound-generating unit-holding parts, the sound-generating unit-holding parts are capable of provisionally holding the sound-generating unit while allowing the sound-generating unit to be slid in a front-rear direction of the electronic keyboard instrument, and the bottoms of the keyboard unit and the top of the sound-generating unit are disposed such that the sound-generating unit can be slid without interference between the sound-generating unit and the keyboard unit held by the keyboard unit-holding parts.

With this arrangement of the electronic keyboard instrument according to the second aspect of the present invention, the sound-generating unit-holding parts are located below the keyboard unit-holding parts, and before the sound-generating unit-holding parts have the sound-generating unit fixed thereto, they provisionally hold the sound-generating unit such that the unit can be slid in the front-rear directions of the instrument. Further, the sound-generating unit is slid without any interference between the sound-generating unit and the keyboard unit. Therefore, the tone-generating unit can be easily mounted or removed singly or separately with the keyboard unit remaining to be held in the instrument.

To attain the above third object, in a third aspect of the present invention, there is provided an electronic keyboard instrument comprising an instrument frame having a pair of left and right legs, and at least one connecting member, the pair of legs being connected together via the connecting member a keyboard unit (KB) having laterally opposite ends (KBa1, KBa2), a keyboard section, and a main circuit section, and a sound-generating unit(SP) having a top having laterally opposite ends (39*a*, 39*b*) and disposed immediately below the keyboard unit, wherein the keyboard unit and the sound-generating unit are held by the instrument frame in a manner such that the laterally opposite ends of the keyboard unit and the laterally opposite ends of the top of the sound-generating unit are directly fixed to the pair of legs of the instrument frame.

With this arrangement of the electronic keyboard instrument according to the third aspect of the present invention, the laterally opposite end parts of the keyboard unit and the sound-generating unit are directly fixed to the pair of legs. Therefore, the keyboard unit and the sound-generating unit can be stably held by the instrument frame without using a keybed. What is more, the sound-generating unit is disposed immediately below the keyboard unit without a keybed interposed therebetween, and therefore there is no member hindering wiring between the two units. Thus, the electronic keyboard instrument according the third aspect of the present invention makes it possible to dispense with the keybed to thereby facilitate wiring between the keyboard unit and the tone-generating unit.

Preferably, each of the pair of legs of the instrument frame has a rear parts the rear parts of the pair of legs are connected together via the connecting member in a manner such that the instrument frame presents a general C shape, in plan view, and is open toward a player, the keyboard unit is secured to the pair of legs of the instrument frame at a location closer to the player than the connecting member of the instrument frame, and movement of the open side of the instrument frame in opening and closing directions is restrained when the keyboard unit is secured to the pair of legs of the instrument frame.

Preferably, an electronic keyboard instrument further comprises a pedal keyboard unit (PK), wherein the instrument frame has a lower part, and the pedal keyboard unit is secured to the lower part of the instrument frame.

Preferably, the pedal keyboard unit has a pair of engaging parts (10L, 10R), the pair of legs of the instrument frame have lower parts, and the pedal keyboard unit is held by the instrument frame in a manner such that the pair of engaging parts are secured to the lower parts of the pair of legs.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing a preferred embodiment thereof.

Figure 1:
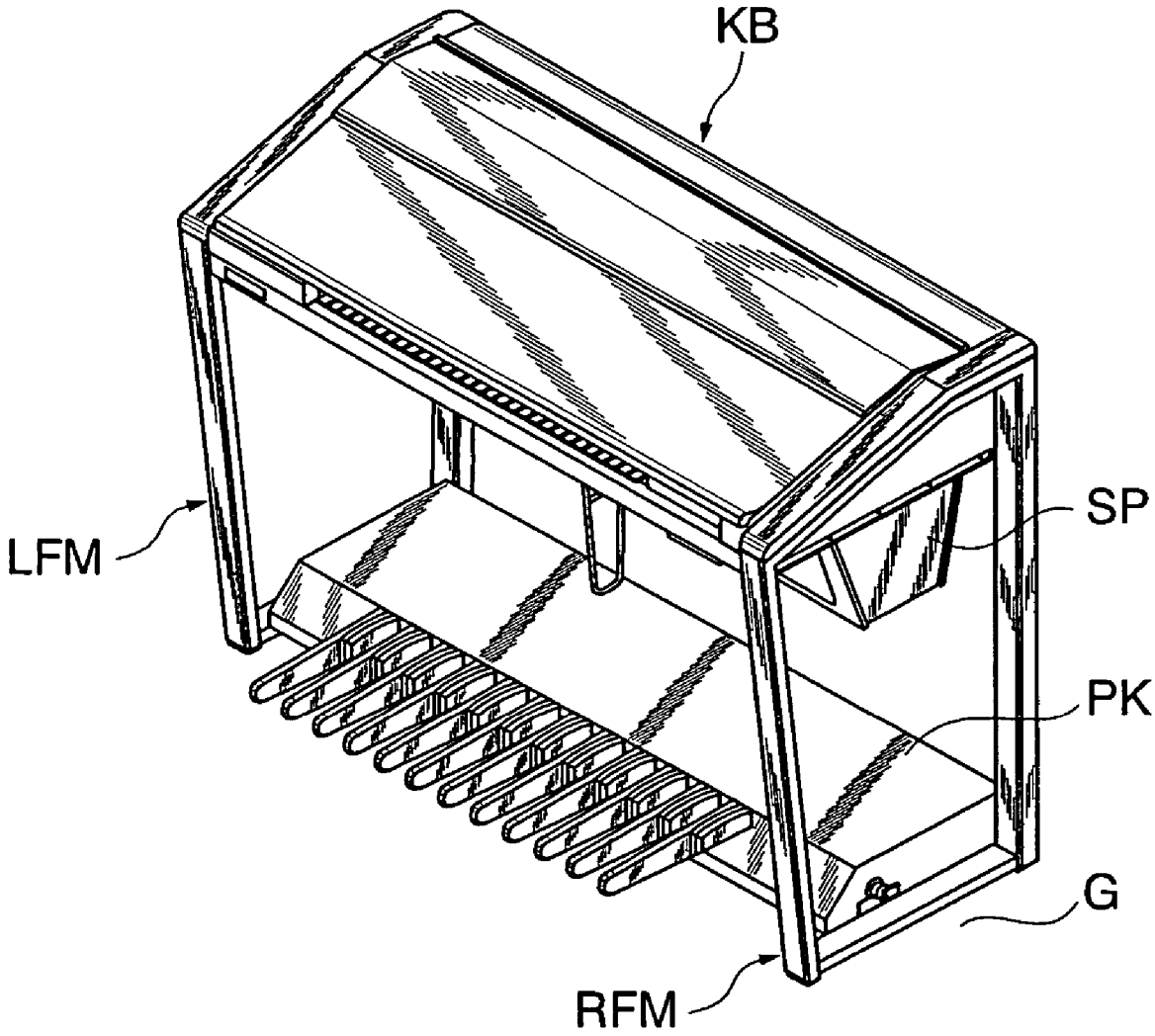
FIG. 1 is a perspective view showing the appearance of an electronic keyboard instrument according to an embodiment of the present invention.
Figures 2A, 2B:
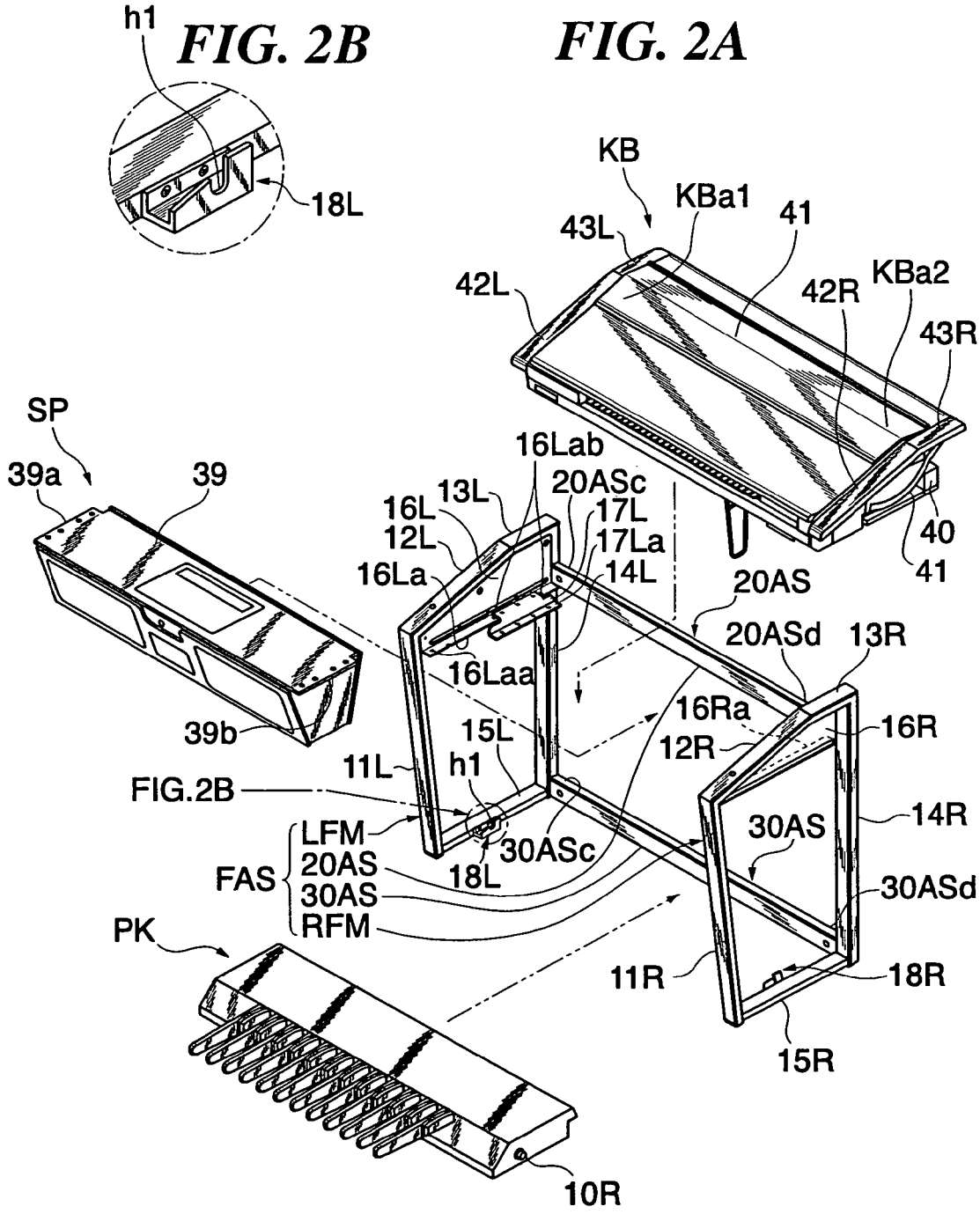
FIG. 2 is an exploded perspective view of the electronic keyboard instrument.

FIG. 1 is a perspective view showing the appearance of an electronic keyboard instrument according to an embodiment of the present invention. FIG. 2 is an exploded perspective view of the electronic keyboard instrument. In the following description, a side of the keyboard instrument according to the present embodiment toward the player will be referred to as "the front side", and a left side and a right side of the same as viewed from the player will be referred to as "the left side" and "the right side", respectively.

As shown in FIG. 2, the electronic keyboard instrument according to the present embodiment is comprised of a frame assembly (instrument frame) FAS, and a keyboard unit KB, a speaker unit (sound-generating unit) SP, and a pedal keyboard unit PK mounted to the frame assembly FAS. The keyboard unit KB is comprised of a main circuit section 40 including a musical tone-generating circuit, a control circuit, and various electric component parts, none of which are shown, and a keyboard section 41 formed in a separate body from the main circuit section 40. The keyboard section 41 is stacked on the main circuit section 40. The keyboard section 41 and the main circuit section 40 are locked to each other at predetermined locations thereof such that they can be united and separated. Further, flanges 42L, 43L, 42R, and 43R are formed integrally with the keyboard unit KB such that the flanges 42L and 43L protrude leftward from a left end KBa1 of the keyboard unit KB, and the flanges 42R and 43R rightward from a right end KBa2 of the same.

As shown in FIG. 2, the frame assembly FAS is comprised of a left frame body LFM and a right frame body RFM as a pair of left and right legs, and an upper connecting member 20AS and a lower connecting member 30AS securely joining together the left and right frame bodies LFM and RFM. The left frame body LFM is comprised of a front strut frame member 11L, an upper front frame member 12L, an upper rear frame member 13L, a rear strut frame member 14L, and a bottom frame member 15L. All these frame members 11L, 12L, 13L, 14L, and 15L are hollow members made mainly of metal, and integrally formed as a one-piece assembly so as to present a generally pentagonal shape in side view. Some of these frame members may be formed as separate pieces and secured to the other frame members e.g. by welding. Similarly, the right frame body RFM is comprised of a front strut frame member 11R, an upper front frame member 12R, an upper rear frame member 13R, a rear strut frame member 14R, and a bottom frame member 15R, which are integrally formed as a one-piece assembly in bilateral symmetry with the left frame body LFM.

A left end 20ASc of the upper connecting member 20AS and a left end 30ASc of the lower connecting member 30AS are secured to the upper and lower parts of the rear strut frame member 14L of the left frame body LFM, respectively, while a right end 20ASd of the upper connecting member 20AS and a right end 30ASd of the lower connecting member 30AS are secured to the upper and lower parts of the rear strut frame member 14R of the right frame body RFM, respectively.

The bottom frame member 15L of the left frame body LFM and the bottom frame member 15R of the right frame body RFM have respective PK mounting parts 18L and 18R projecting inward in opposed relation to each other. On the other hand, the pedal keyboard unit PK has engaging parts 10L and 10R (only the engaging part 10R is shown in FIG. 2) projecting from respective bilaterally symmetric positions of left and right ends thereof. Each of the PK mounting parts 18L and 18R is formed therein with a recess h1 open upward for having the engaging part 10L (10R) fitted therein to retain the same. The PK mounting parts 18L and 18R are engaged with the respective engaging parts 10L and 10R of the pedal keyboard unit PK, whereby the pedal keyboard unit PK is held by the two frame bodies LFM and RFM. Thus, the pedal keyboard unit PK is easily mounted to the frame assembly FAS. After mounting of the pedal keyboard unit PK to the frame assembly FAS, the bottom of the pedal keyboard unit PK or the bottoms of legs, not shown, of the pedal keyboard unit PK become substantially flush with an installation surface (floor surface) G (see FIG. 1). Therefore, normally, the pedal keyboard unit PK is also held or supported by the installation surface G at least during operation of the instrument.

Left and right side covers 16L and 16R are attached to the insides of the left and right frame bodies LFM and RFM, respectively, in opposed relation to each other. The two side covers 16L and 16R are fixed to the respective frame bodies LFM and RFM e.g. by welding.

Figure 3A:
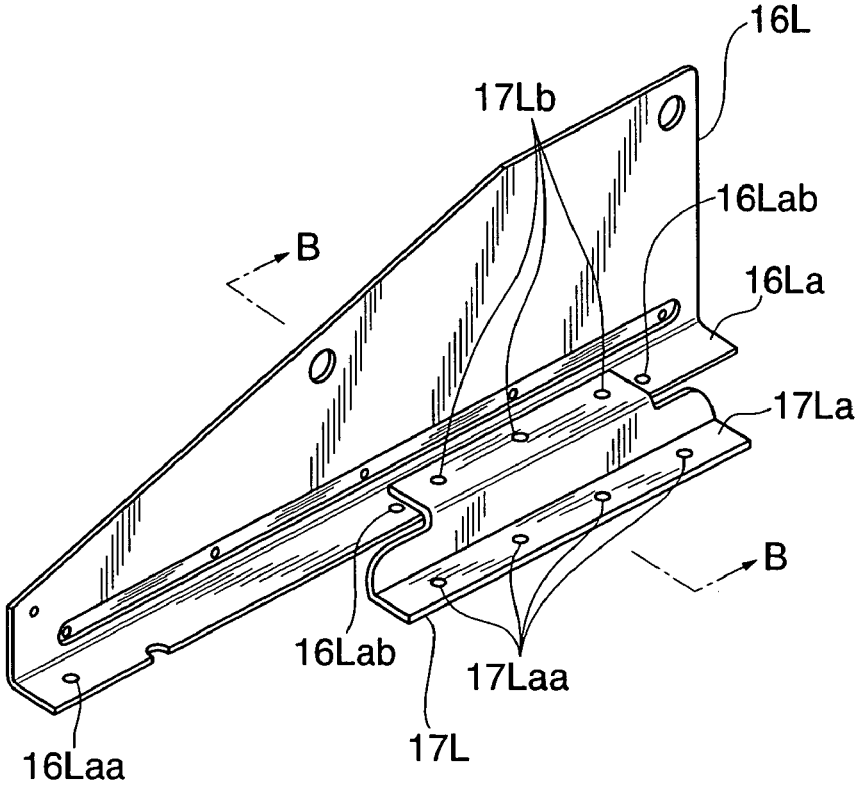
FIG. 3A is a perspective view showing the appearance of a left side cover and component parts associated therewith.
Figure 3B:
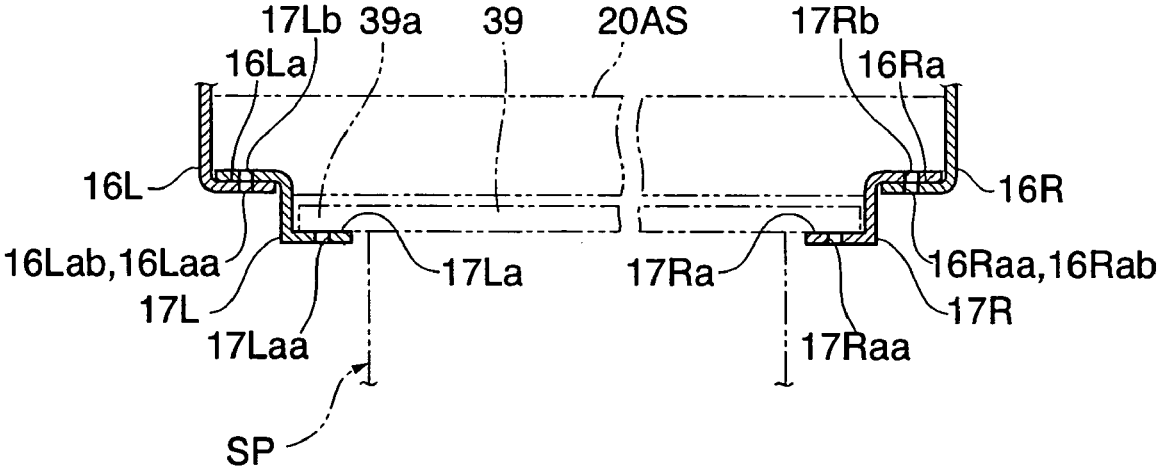
FIG. 3B is a fragmentary cross-sectional view of the electronic keyboard instrument, taken on line B-B in FIG. 3A.

FIG. 3A is a perspective view showing the appearance of the left side cover 16L and component parts associated therewith. FIG. 3B is a fragmentary cross-sectional view of the electronic keyboard instrument, taken on line B-B in FIG. 3A.

As shown in FIGS. 3A and 3B, the left side cover 16L has a lower end thereof bent inward (rightward) to form a horizontal part extending inward and functioning as a keyboard unit-holding part 16La that holds the keyboard unit KB. The keyboard unit-holding part 16La is formed therein with one mounting hole 16Laa and two mounting holes 16Lab, for example.

Further, the keyboard unit-holding part 16La has a stay member 17L attached thereto. The stay member 17L is formed of two, i.e. upper and lower, step-like horizontal parts. The upper horizontal part is formed therein with a plurality of (e.g. three) screw holes 17Lb, and the keyboard unit-holding part 16La is formed therein with holes, not shown, associated with the respective screw holes 17Lb. Screws are screwed into the respective screw holes 17Lb in the stay member 17L from below via the holes, not shown, in the keyboard unit-holding part 16La and tightened, whereby the stay member 17L is fixed to the keyboard unit-holding part 16La. The lower horizontal part of the stay member 17L is located slightly lower, i.e. one step lower than the keyboard unit-holding part 16La, and forms a speaker unit-holding part 17La that holds the speaker unit SP. The speaker unit-holding part 17La is formed therein with a plurality of (e.g. four) mounting holes 17Laa for use in mounting the speaker unit SP.

Similarly, as shown in FIG. 3B, the right side cover 16R attached to the right frame body RFM is formed with a keyboard unit-holding part 16Ra and mounting holes 16Raa and 16Rab, in bilateral symmetry with the keyboard unit-holding part 16La and the mounting holes 16Laa and 16Lab. Further, the right side cover 16R has a stay member 17R attached thereto in bilateral symmetry with the stay member 17L, and the stay member 17R has screw holes 17Rb, a speaker unit-holding part 17Ra, and mounting holes 17Raa, not all of which are shown, formed in bilateral symmetry with the screw holes 17Lb, the speaker unit-holding part 17La, and the mounting holes 17Raa. The speaker unit-holding part 17La and the speaker unit-holding part 17Ra form a pair of "sound-generating unit-holding parts".

Figure 4:
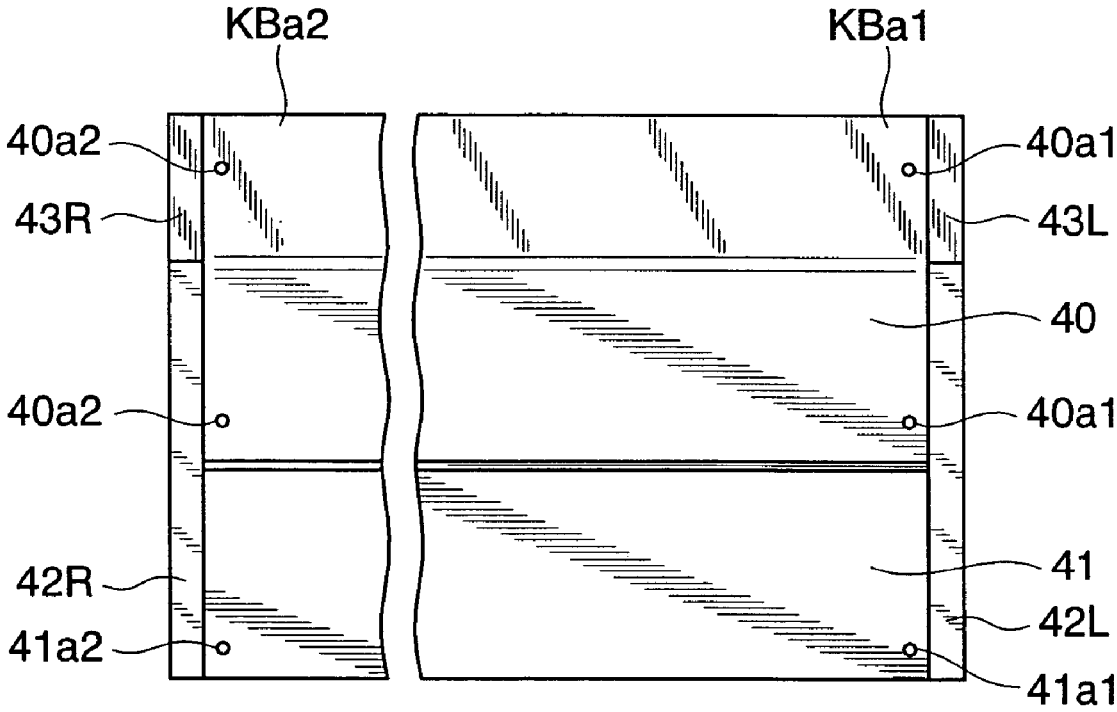
FIG. 4 is a bottom view of a keyboard unit.

FIG. 4 is a bottom view of the keyboard unit KB. In the left end KBa1 of the keyboard unit KB, a single screw hole 41*a*1, for example, is formed in the lower surface of the keyboard section 41, and two screw holes 40*a*1, for example, are formed in the lower surface of the main circuit section 40. Similarly, in the right end KBa2 of the keyboard unit KB, a single screw hole 41*a*2, for example, is formed in the lower surface of the keyboard section 41, and two screw holes 40*a*2, for example, are formed in the lower surface of the main circuit section 40.

The screw holes 41*a*1, 40*a*1, 41*a*2, and 40*a*2 correspond in position, respectively, with the mounting holes 16Laa and 16Lab of the keyboard unit-holding part 16La and the mounting holes 16Raa and 16Rab of the keyboard unit-holding part 16Ra. Screws are screwed through the screw holes 41*a*1, 40*a*1, 41*a*2, and 40*a*2 with the associated mounting holes aligned with each other and tightened, whereby the keyboard unit KB is held by the left frame body LFM and the right frame body RFM via the keyboard unit-holding parts 16La and 16Ra.

The flanges 42L and 43L (42R and 43R) of the keyboard unit KB are formed to have a shape in side view corresponding to the shape in side view of the upper front and rear frames 12L and 13L (12R and 13R) of the left frame body LFM (right frame body RFM), such that a slight gap is formed between the flanges 42L and 43L (42R and 43R) and the frames 12L and 13L (12R and 13R), when the keyboard unit KB is held by the frame assembly FAS. In other words, the keyboard unit KB is not held by other means but by the keyboard unit-holding parts 16La and 16Ra, and the flanges 42L and 43L (42R and 43R) formed of resin only function as a cover for the component parts playing the role of an arm.

Further, as shown in FIG. 2, the speaker unit SP has a top plate 39 fixed to an upper part thereof, and the laterally opposite ends of the top plate 39 are formed as respective held parts 39*a* and 39*b* which protrude in the form of flanges. These held parts 39*a* and 39*b* are placed on the speaker unit-holding parts 17La and 17Ra (see FIG. 3B), respectively, and screwed thereto from below via the respective four mounting holes 17Laa and 17Raa, whereby the speaker unit SP is held by the left and right frame bodies LFM and RFM via the speaker unit-holding parts 17La and 17Ra. The keyboard unit-holding parts 16La and 16Ra and the speaker unit-holding parts 17La and 17Ra are vertically close to each other, that is, the speaker unit SP is positioned immediately below the keyboard unit KB. Further, the keyboard unit-holding parts 16La and 16Ra and the speaker unit-holding parts 17La and 17Ra are located separately from each other, and hence the keyboard unit KB and the speaker unit SP can be mounted and removed separately to and from the frame assembly FAS.

In a state where the held parts 39*a* and 39*b* of the speaker unit SP are placed on the speaker unit-holding parts 17La and 17Ra but not yet fixed thereto with screws, the speaker unit-holding parts 17La and 17Ra provisionally hold the speaker unit SP such that the speaker unit SP can be slid in the transverse direction thereof (in the front-rear direction of the electronic keyboard instrument). What is more, the speaker unit SP can be slid without interference between the speaker unit SP and the keyboard unit KB held by the keyboard unit-holding parts 16La and 16Ra. More specifically, while the keyboard unit-holding parts 16La and 16Ra support the bottom of the keyboard unit KB, the speaker unit-holding parts 17La and 17Ra support the top plate 39 of the speaker unit SP as the top thereof, and at the same time, the speaker unit-holding parts 17La and 17Ra are located at lower positions than the keyboard unit-holding parts 16La and 16Ra, so that no interference between the bottom of the keyboard unit KB and the upper surface of the top plate 39 of the speaker unit SP can occur. Thus, even in the state where the keyboard unit KB remains held by the frame assembly FAS, the speaker unit SP can be separately mounted or removed from the frame assembly FAS, by the simple operation of sliding the same.

In general, a keybed does not only have the function of holding component parts, such as a keyboard unit and a speaker unit, but also the function of reinforcing an instrument frame, and therefore is usually provided in electronic keyboard instruments. However, the electronic keyboard instrument according to the present embodiment is not provided with a keybed, but instead, in the present embodiment, the keyboard unit-holding parts 16La and 16Ra hold the left and right ends KBa1 and KBa2 of the keyboard unit KB as the left and right ends thereof and the speaker unit-holding parts 17La and 17Ra hold the held parts 39*a* and 39*b* of the speaker unit SP as the left and right ends thereof, whereby the keyboard unit KB and the speaker unit SP are directly secured to the left and right frame bodies LFM and RFM not via a keybed, though only via the side covers 16L and 16R and the stay members 17L and 17R.

Thus, the keyboard unit KB and the speaker unit SP are stably held by the frame assembly FAS without using a keybed. Further, since the speaker unit SP is held immediately below the keyboard unit KB without a keybed or the like interposed therebetween, wiring between the two units can be easily carried out without being hindered by any member. Although not shown, for wiring between the keyboard unit KB and the speaker unit SP, a desired spot can be selected from a wide area where the keyboard unit KB and the speaker unit SP face each other, for wiring. A power cord from the main circuit section 40 and cables connecting between the pedal keyboard unit PK and the main circuit section 40 can be passed through the inside of the hollow rear strut frame 14R, for example. This makes it easy to hide as much of the connection wiring and the power cord as possible from view from the outside.

Although only one type of keyboard unit KB and only one type of speaker unit SP are shown in FIG. 2, in the present embodiment, a plurality of types of keyboard units KB and a plurality of types of speaker units SP are prepared in advance, and desired ones of those units are selectively secured to the frame assembly FAS, so that a plurality of types of electronic keyboard instruments can be obtained using a frame assembly FAS having the same construction, during manufacture and/or after delivery of the instrument.

More specifically, the frame assembly FAS is common to all the types of electronic keyboard instruments, and therefore the constructions of the keyboard unit-holding parts 16La and 16Ra and the speaker unit-holding parts 17La and 17Ra are also common to all the instrument types. Therefore, first, the configurations of the opposite ends KBa1 and KBa2 and screw holes 41*a*1, 40*a*1, 41*a*2, and 40*a*2 of the keyboard unit KB are designed to be common to all the types. Further, at least the held parts 39*a* and 39*b* of the speaker unit SP are designed to be common to all the types.

The keyboard unit KB can be formed for use in different types of electronic keyboard instruments e.g. by changing functions thereof and operating elements provided thereon, the number of rows of keys of keyboards, or the keyboard structure itself (i.e. changing the grade of the keyboard). Further, although in the illustrated example of FIG. 2, the speaker unit SP has only a speaker section facing forward, this is not limitative, but a speaker unit SP also having a speaker section facing rearward for use in on-stage performance, or a speaker unit having only a speaker section facing rearward may be provided as a replacement. Particularly, all types of speaker units SP may be designed to have a common top plate 39, which makes it easy to freely vary the designs of the other parts. Alternatively, the speaker unit SP may be configured such that even after the speaker unit SP is laterally reversed, the held parts 39*a* and 39*b* present the same shape with the top plate 39 mounted on the speaker unit SP, thereby allowing the speaker unit SP to be held by the speaker unit-holding parts 17La and 17Ra even when the speaker unit SP is reversed in the front-rear direction. This makes it possible to mount the speaker unit SP in a selected orientation such that the speaker section faces forward or rearward, after delivery of the instrument including the speaker unit SP.

Normally, during manufacture, the speaker unit SP is attached to the frame assembly FAS by being slid rearward from the front of the frame assembly FAS. However, as shown in FIG. 3B, the upper connecting member 20AS is located above the top plate 39 of the speaker unit SP such that no interference between the former and the latter can occur. Therefore, it is also possible to attach the speaker unit SP to the frame assembly FAS by sliding the same forward from the rear of the frame assembly FAS. Particularly, in attaching the speaker unit SP to the frame assembly FAS after delivery, an operator provided at a lower front of the keyboard unit KB, for adjustment of the tone volume and acoustic effects, etc. can form an obstacle to the operation of installation, and hence it is often easier to insert or remove the speaker unit SP from the rear of the frame assembly FAS than from the front.

As to the pedal keyboard unit PK as well, the configurations of the engaging parts 10L and 10R, for example, common to all pedal keyboard units PK for different types of electronic keyboard instruments, as is the case with the keyboard unit KB etc., thus making it possible to realize multiple instrument types using the same frame assembly FAS.

As described hereinbefore, the frame assembly FAS is formed by connecting the rear strut frames 14L and 14R via the upper and lower connecting members 20AS and 30AS. Thus, the frame assembly FAS has a general C shape, in plan view, and is open toward the player side, and therefore it is vulnerable to a force acting in the direction of opening or closing the open side of the C shape in particular. However, the movement of the open side of the frame assembly FAS in the opening and closing directions is frame in opening and closing directions is restrained by the keyboard unit KB, which are fastened to the keyboard unit-holding parts 16La and 16Ra with screws, as described hereinabove. As a result, when the electronic keyboard instrument is completed, the open side of the frame assembly FAS is not allowed to move in the opening and closing directions, whereby the electronic keyboard instrument has high rigidity in all directions. Further, the fixing of the speaker unit SP to the speaker unit-holding parts 17La and 17Ra, and the fixing of the pedal keyboard unit PK to the PK mounting parts 18L and 18R also contribute to ensuring the rigidity of the entire electronic keyboard instrument.

According to the present embodiment, it is possible to selectively use desired ones of a plurality of types of keyboard units KB and a plurality of types of speaker units SP to be held by the frame assembly FAS. As a result, it is not only possible to share the frame assembly by different instrument types, to thereby enable manufacture of lots of types of electronic keyboard instruments using a smaller number of component parts or modification of the type of the electronic keyboard instrument after delivery thereof, but also to facilitate separate replacement or mounting and removal of the keyboard unit KB and the speaker unit SP.

Further, the speaker unit SP can be fixed in place after provisionally holding the same by the frame assembly FAS such that the speaker unit SP can be slid in the front-rear directions without interfering with the keyboard unit KB held by the frame assembly FAS. As a result, the speaker unit SP can be easily mounted or removed singly or separately, with the keyboard unit KB remaining secured to the frame assembly FAS. Particularly, this also facilitates operations of maintenance.

Furthermore, since the laterally opposite ends of the keyboard unit KB and the speaker unit SP are directly secured to the left and right frame bodies LFM and RFM, a keybed can be dispensed with, which can facilitate wiring and electrical connections between the two units.

Moreover, by securing the keyboard unit KB and other components to the frame assembly FAS, the movement of the open side of the frame assembly FAS in the opening and closing directions is restrained, so that high rigidity of the entire electronic keyboard instrument can be ensured. The keyboard unit KB is an essential component, by virtue of this arrangement, unnecessary complication of the construction of the electronic keyboard instrument can be avoided. In particular, the upper connecting member 20AS, the keyboard unit-holding parts 16La and 16Ra, and the speaker unit-holding parts 17La and 17Ra are disposed substantially on the same plane, i.e. substantially flush with each other, when the entire frame assembly FAS is viewed as a whole, as shown in FIG. 3. As a result, the upper connecting member 20AS, the keyboard unit KB, and the speaker unit SP cooperate with each other to contribute to ensuring the rigidity of the frame assembly FAS.

From this viewpoint, as described below by way of example, the supporting parts disposed substantially on the same plane as the upper connecting member 20AS are not limited to the supporting parts for supporting the keyboard unit KB and the speaker unit SP, and the number thereof is not limited, either.

Figure 5:
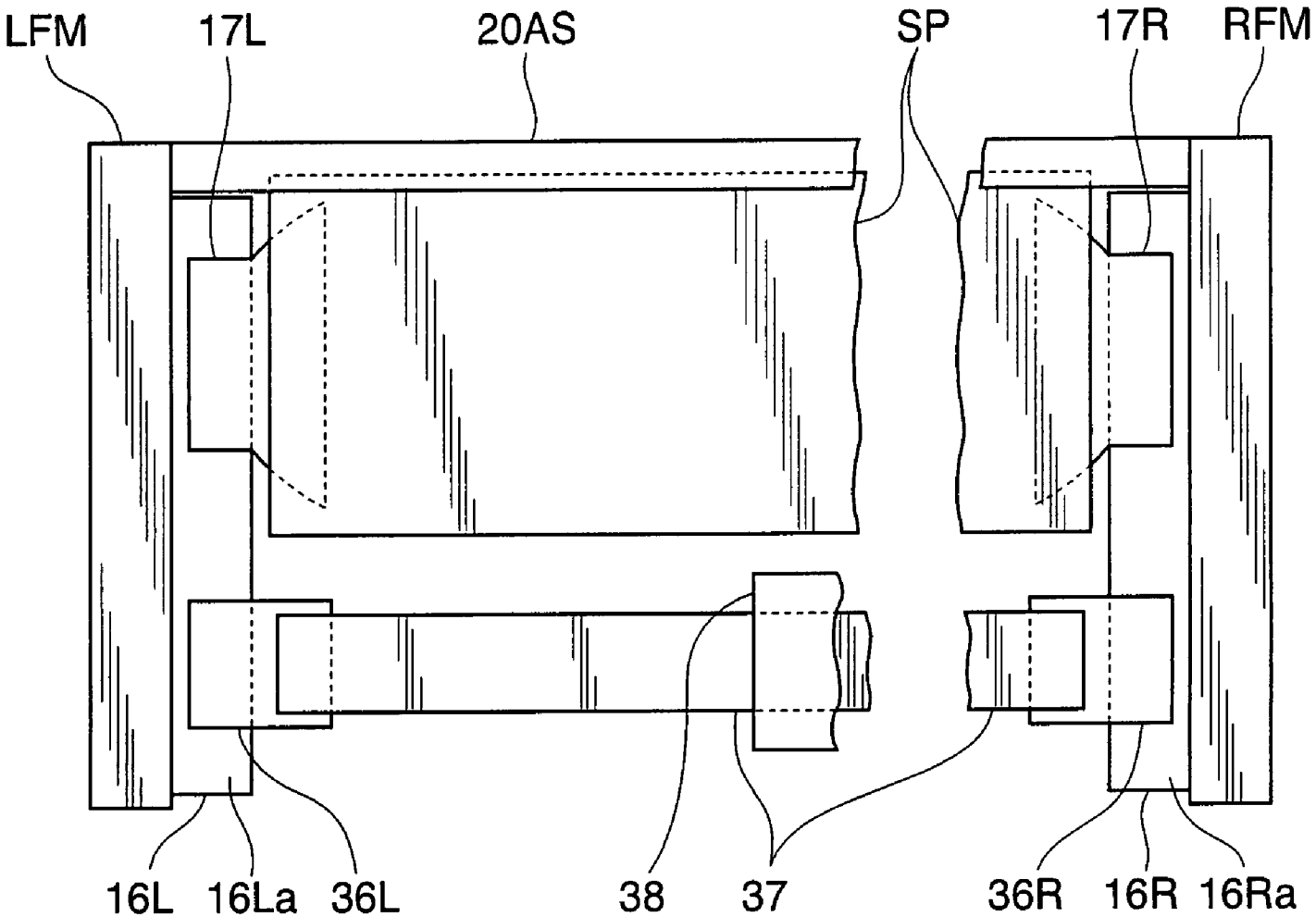
FIG. 5 is a fragmentary plan view of an electronic keyboard instrument according to a variation of the embodiment of the present invention.

FIG. 5 is a fragmentary plan view of an electronic keyboard instrument according to a variation of the above-described embodiment, and wherein illustration of the keyboard unit KB is omitted. In FIG. 5, the arrangement and configurations of the upper connecting member 20AS, the left and right frame bodies LFM and RFM, and the left and right side covers 16L and 16R are identical to those in the above-described embodiment. The present variation is distinguished from the above-described embodiment in that mixer-holding members 36L and 36R are additionally attached to the keyboard unit-holding parts 16La and 16Ra at respective locations forward of the stay members 17L and 17R, with a mixer stay 37 bridging the mixer-holding members 36L and 36R, and a mixer 38 being fixed to the mixer stay 37. The mixer-holding members 36L and 36R hold the mixer stay 37 at the same vertical level as that of the speaker unit-holding parts 17La and 17Ra (see FIG. 3B).

In this variation, when the entire frame assembly FAS is viewed as a whole, the mixer-holding members 36L and 36R are also disposed substantially on the same plane as the keyboard unit-holding parts 16La and 16Ra, so that not only the keyboard unit KB and the speaker unit SP but also the mixer stay 37 serves to increase the rigidity of the frame assembly FAS. The component fixed to the mixer stay 37 is not limited to the mixer 38, but a desired one of various components may be fixed to the mixer stay 37.

Although in the above-described embodiment, the upper and lower connecting members 20AS and 30AS are employed as two connecting members, the number of connecting members is not limited to two.

By varying the length of the upper and lower connecting members 20AS and 30AS, it is possible to use the same left and right frame bodies LFM and RFM for keyboard units KB different in the number of keys, particularly for keyboard units KB different in width.

Further, insofar as the pedal keyboard unit PK is concerned, the present invention is also applicable to electronic keyboard instruments which are not provided with the pedal keyboard unit PK by design.

What is claimed is:

1. An electronic keyboard instrument comprising:

an instrument frame having a pair of left and right legs, and at least one connecting member, said pair of legs being connected together via said connecting member;

a pair of keyboard unit-holding parts provided respectively on said pair of legs of said instrument frame, said keyboard unit-holding parts being capable of selectively holding one of a plurality of types of keyboard units; and a pair of sound-generating unit-holding parts provided respectively on said pair of legs of said instrument frame, separately from said keyboard unit-holding parts, said sound-generating unit-holding parts being capable of selectively holding one of a plurality of types of sound-generating units such that one of the plurality of types of sound-generating units is spaced away from the one of the plurality of types of keyboard units, wherein the plurality of types of sound-generating units have held parts thereof and other parts thereof that are differently designed from one another.

2. An electronic keyboard instrument of claim 1, further comprising:

a keyboard unit having laterally opposite ends, a keyboard section, and a main circuit section; and a sound-generating unit having a top having laterally opposite ends and disposed immediately below said keyboard unit so as to be spaced apart from said keyboard unit, said sound-generating unit including a speaker unit, wherein said keyboard unit and said sound-generating unit are held by said instrument frame in a manner such that said laterally opposite ends of said keyboard unit and said laterally opposite ends of said top of said sound-generating unit are directly fixed to said pair of legs of said instrument frame.

3. An electronic keyboard instrument as claimed in claim 2, wherein each of said pair of legs of said instrument frame has a rear part, wherein said rear parts of said pair of legs are connected together via said connecting member in a manner such that said instrument frame presents a general C shape, from a top view, and is open toward a player; and wherein said keyboard unit is secured to said pair of legs of said instrument frame at a location in closer proximity to the player than to said connecting member so as to cover said connecting member, causing said connecting member to be invisible from a point of view of the player, and wherein said instrument frame is rigidly secured from deformation when said keyboard unit is secured to said pair of legs of aid instrument frame.

4. An electronic keyboard instrument as claimed in claim 3, wherein:

said pedal keyboard unit has a pair of engaging parts;

said pair of legs of said instrument frame have lower parts; and said pedal keyboard unit is held by said instrument frame in a manner such that said pair of engaging parts are secured to said lower parts of said pair of legs.

5. An electronic keyboard instrument as claimed in claim 3, wherein each of said legs comprises metallic hollow members formed integrally as one-piece assembly.

6. An electronic keyboard instrument as claimed in claim 5, further comprising a pedal keyboard unit, wherein said instrument frame has a lower part, and said pedal keyboard unit is secured to said lower part of said instrument frame.

7. An electronic keyboard instrument comprising:

an instrument frame having a pair of left and right legs, and at least one connecting member, said pair of legs being connected together via said connecting member;

a keyboard unit having laterally opposite ends having respective bottoms, and a keyboard section;

a sound-generating unit having a top having laterally opposite ends;

a pair of keyboard unit-holding parts provided respectively on said pair of legs of said instrument frame at locations inward of and between said pair of legs in opposed relation to each other, said keyboard unit-holding parts supporting respectively said laterally opposite ends of said keyboard unit; and a pair of sound-generating unit-holding parts provided respectively on said pair of legs of said instrument frame at locations inward of and between said pair of legs in opposed relation to each other, said sound-generating unit-holding parts holding said sound-generating unit such that said sound-generating unit is spaced apart from said keyboard unit, while said laterally opposite ends of said top of said sound-generating unit are fixed to said sound-generating unit-holding parts, wherein said sound-generating unit-holding parts are located at a level below said keyboard unit-holding parts, whereby, when said laterally opposite ends of said top of said sound-generating unit are not fixed to said sound-generating unit-holding parts, said sound-generating unit-holding parts are capable of provisionally holding said sound-generating unit while allowing said sound- generating unit to be slid in a front-rear direction of the electronic keyboard instrument, and said bottoms of said keyboard unit and said top of said sound-generating unit are disposed such that said sound-generating unit can be slid without interference between said sound-generating unit and said keyboard unit held by said keyboard unit-holding parts.

8. An electronic keyboard instrument of claim 7, further comprising a sound-generating unit having a top having laterally opposite ends and disposed immediately below said keyboard unit so as to be spaced apart from said keyboard unit, said sound-generating unit including a speaker unit, wherein said keyboard unit and said sound-generating unit are held by said instrument frame in a manner such that said laterally opposite ends of said keyboard unit and said laterally opposite ends of said top of said sound-generating unit are directly fixed to said pair of legs of said instrument frame.

9. The electronic keyboard instrument as claimed in claim 8, wherein each of said pair of legs of said instrument frame has a rear part, wherein said rear parts of said pair of legs are connected together via said connecting member in a manner such that said instrument frame presents a general C shape, from a top view, and is open toward a player; and wherein said keyboard unit is secured to said pair of legs of said instrument frame at a location in closer proximity to the player than to said connecting member so as to cover said connecting member, causing said connecting member to be invisible from a point of view of the player, and wherein said instrument frame is rigidly secured from deformation when said keyboard unit is secured to said pair of legs of aid instrument frame.

10. An electronic keyboard instrument as claimed in claim 9, wherein:

said pedal keyboard unit has a pair of engaging parts;

said pair of legs of said instrument frame have lower parts; and said pedal keyboard unit is held by said instrument frame in a manner such that said pair of engaging parts are secured to said lower parts of said pair of legs.

11. An electronic keyboard instrument as claimed in claim 9, wherein each of said legs comprises metallic hollow members formed integrally as one-piece assembly.

12. An electronic keyboard instrument as claimed in claim 11, further comprising a pedal keyboard unit, wherein said instrument frame has a lower part, and said pedal keyboard unit is secured to said lower part of said instrument frame.

* * * * *